US011094433B2

(12) United States Patent
Vuylsteke

(10) Patent No.: US 11,094,433 B2
(45) Date of Patent: Aug. 17, 2021

(54) BRAIDED FLAT CONDUCTIVE TAPE

(71) Applicant: FORD GLOBAL TECHNOLOGIES, LLC, Dearborn, MI (US)

(72) Inventor: Gabrielle Elizabeth Moilanen Vuylsteke, Ann Arbor, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 259 days.

(21) Appl. No.: 16/424,615

(22) Filed: May 29, 2019

(65) Prior Publication Data

US 2020/0381145 A1 Dec. 3, 2020

(51) Int. Cl.
*H01B 13/00* (2006.01)
*H01B 7/08* (2006.01)

(52) U.S. Cl.
CPC ..... *H01B 13/0036* (2013.01); *H01B 7/0869* (2013.01)

(58) Field of Classification Search
CPC ..... H01B 7/0869; H01B 13/0036
See application file for complete search history.

(56) References Cited

U.S. PATENT DOCUMENTS 2,939,099 A * 5/1960 Morey ..... H05B 3/565 338/243
2,982,932 A * 5/1961 Morey ..... H05B 3/565 338/212
2,985,860 A * 5/1961 Morey ..... H05B 3/56 338/208
3,268,846 A * 8/1966 Morey ..... H05B 3/56 338/212
3,555,170 A * 1/1971 Petzetakis ..... F16L 11/127 174/47
4,415,765 A * 11/1983 Iwasa ..... H01B 7/365 174/112
4,701,598 A * 10/1987 Cooper ..... H05B 1/0244 219/535

FOREIGN PATENT DOCUMENTS

| | | | |
|---|---|---|---|
| JP | 45-19944 | * | 8/1970 |
| JP | 63-129918 | * | 8/1988 |
| JP | 05-008716 Y | * | 3/1993 |
| JP | 05-048591 B | * | 7/1993 |
| JP | 2002343140 A | | 11/2002 |
| JP | 2005174689 A | | 6/2005 |
| JP | 2016207402 A | | 12/2016 |
| JP | 2017220399 A | | 12/2017 |
| JP | 2018101627 A | | 6/2018 |

OTHER PUBLICATIONS https://www.proglass.de/88/adhesive-tapes,-glues-&-rubber-profiles/adhesives-tapes-on-rolls/woven-adhesives-tape-black,-50-mm-wide-reel-at-50-m-stg-5050.htm.

* cited by examiner

*Primary Examiner* — Carl J Arbes
(74) *Attorney, Agent, or Firm* — Frank L. Lollo; MacMillan, Sobanski & Todd, LLC

(57) ABSTRACT

A method of forming a flat conductor that includes aligning multiple strands of flat conductive tape adjacent to each other, and braiding the strands of flat conductive tape to each other by sequentially bending one of the strands of flat conductive tape over the other strands of flat conductive tape to create a braided flat conductive tape. Each end of the braided flat conductive tape is connected to an electrical assembly for carrying electrical current therethrough.

14 Claims, 4 Drawing Sheets

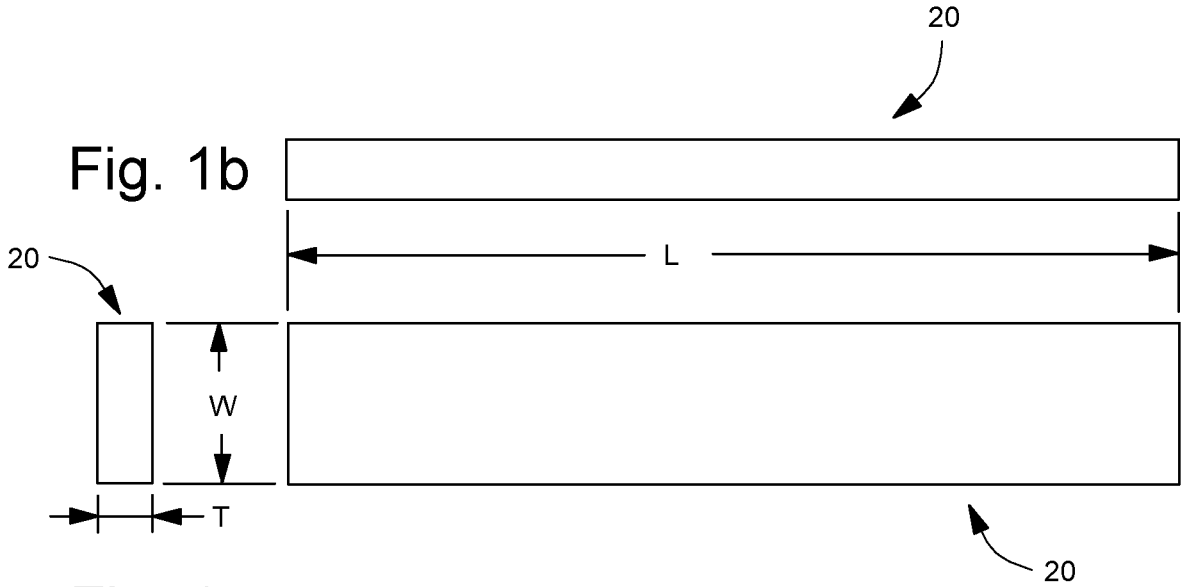
Fig. 1b
Fig. 1c
Fig. 1a
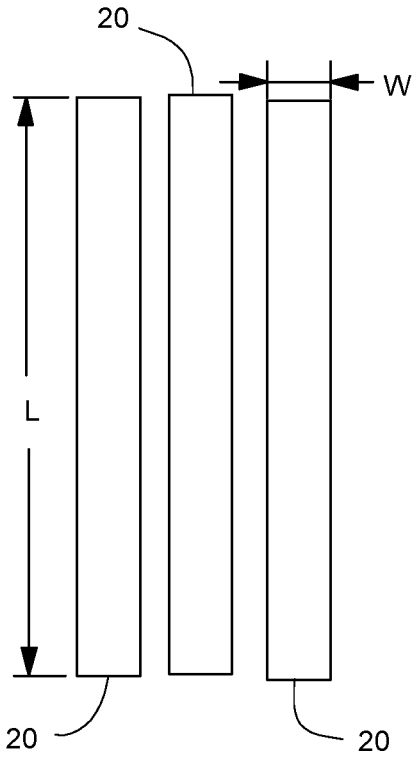
Fig. 2a
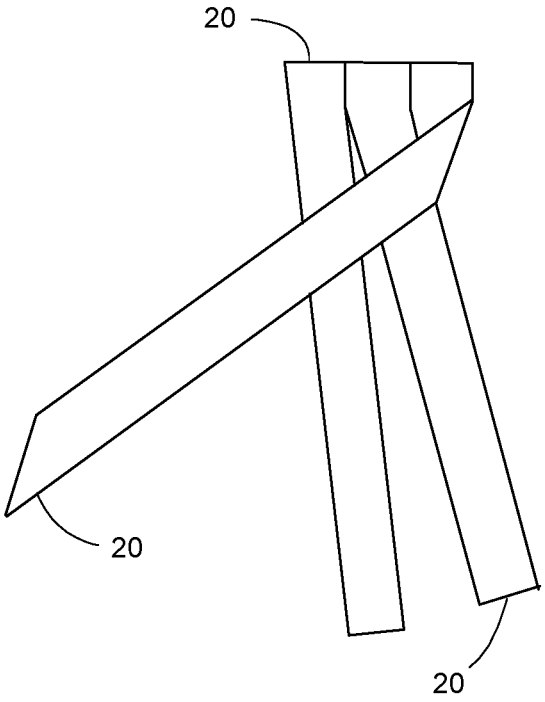
Fig. 2b

BRAIDED FLAT CONDUCTIVE TAPE

BACKGROUND OF THE INVENTION

The present invention relates to flat conductors and more particularly to braided flat conductive tape.

When in need of low profile and improved packaging for conductors, flat conductors such as conductive copper tape and printed/painted circuits may be beneficial. However, while conductive tape is generally flexible when bent in the direction of the tape's thickness, it is generally inflexible when attempting to bend (curve) it in the direction of the tape width. Such a drawback may make creating curved conductors on a surface out of tape impractical in addition to needing some type of tension relief along the length of a conductive tape bent in the direction of the tape width. Also, the tape is generally inflexible along its length. However, flat conductors mounted on a solid surface need to be able to withstand stresses from temperature variation and forces acting on the solid surface. Thus, if tension relief is not included in the design, the flat conductor may not operate as desired.

Some have attempted braiding round wire conductors and then flattening the round wires after braiding. But this creates a compressed structure that is no longer freely woven together.

SUMMARY OF THE INVENTION

An embodiment contemplates a method of forming a flat conductor comprising: aligning multiple strands of flat conductive tape adjacent to each other; braiding the strands of flat conductive tape to each other by sequentially bending one of the strands of flat conductive tape over the other strands of flat conductive tape to create a braided flat conductive tape; and connecting each end of the braided flat conductive tape to an electrical assembly for carrying electrical current therethrough.

An embodiment contemplates a method of forming a flat conductor comprising: aligning multiple strands of flat conductive tape adjacent to each other; braiding the strands of flat conductive tape to each other by sequentially bending one of the strands of flat conductive tape over the other strands of flat conductive tape to create a braided flat conductive tape; and applying adhesive in segments, with each of the segment of the adhesive applied to only one of the strands of the braided flat conductive tape, allowing for relative movement between the strands of the flat conductive tape.

An advantage of an embodiment is that integrating multiple flat conductors into a braided flat conductive tape may allow for ease in following a curved path for the conductors, as well as readily allowing for expansion and contraction of the braided flat conductive tape. This allows for flat substrate mounted conductors that have a low profile and improve packaging while maintain the desired flexibility of flat tape. Additionally, such braided flat conductive tape may be sized to carry various electric currents for prolonged periods.

Another advantage of an embodiment is that adhesive may be employed to secure the braided flat conductive tape to a substrate while minimally hindering the flexibility of the conductor.

BRIEF DESCRIPTION OF THE DRAWINGS

FIGS. 1*a*-1*c* are different views of a flat conductive tape.

FIGS. 2*a*-2*e* illustrate a process for turning multiple strips of flat conductive tape into a braided flat conductive tape.

DETAILED DESCRIPTION

FIGS. 1*a*-1*c* illustrate a piece of flat conductive tape 20, with FIG. 1*a* showing the tape's length L and width W, FIG. 1*b* showing the tape's length L and thickness T, and FIG. 1*c* showing the tape's width W and thickness T. One will note that, with the conductor being flat tape, the thickness is much less than the width, which may be much less than the length. Such relative dimensions as illustrated in FIGS. 1*a*-1*c* may be common for flat conductive tape 20.

FIGS. 2*a*-2*e* illustrate how multiple pieces of flat conductive tape 20 are braided together to form braided flat conductive tape 22 (in this example three pieces, although there may be different numbers of flat conductive tape that are braided together). Since multiple pieces of flat conductive tape 20 are braided together, each individual length of tape may have a narrower width W than a conventional single piece of flat conductive tape that might be employed to carry the desired amount of electrical current (e.g., the three pieces 20 to be braided together may be about one-third the width W as compared to when one is employing only a single piece of flat conductive tape to carry the desired current). In addition, since the strands 20 of tape are being braided, the length of each of the three stands of tape 20 may have a longer length L than when employing a conventional single piece of tape in order to account for the bending and overlapping of the strands of tape that occurs during the braiding process.

Figure 2C:
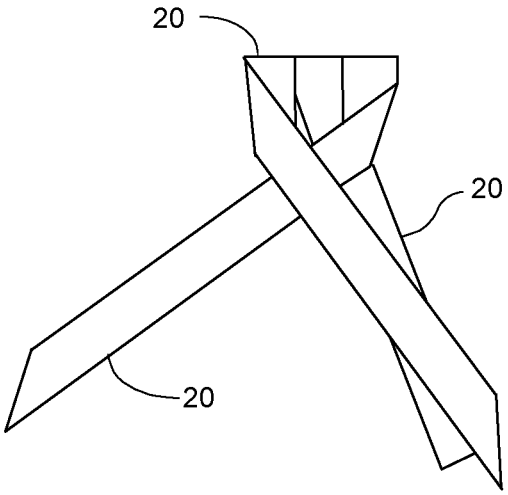
Figure 2D:
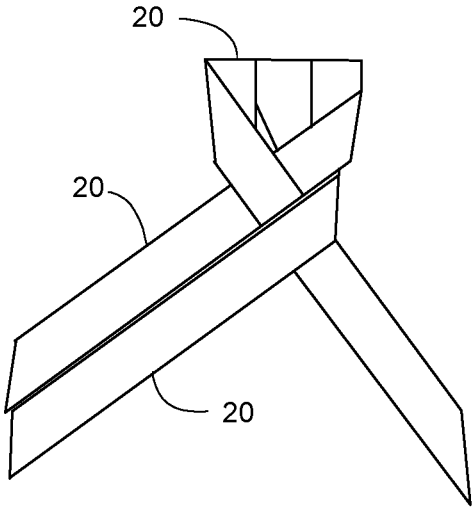
Figure 2E:
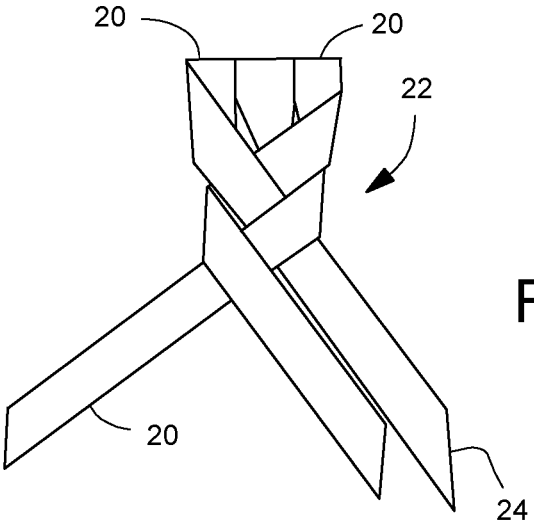

In this example of braiding the flat conductive tape 20, three individual strands of tape 20 are located adjacent to each other along their lengths L (FIG. 2*a*). A first strand 20 is bent and extended diagonally across the other two strands (FIG. 2*b*). The first strand 20 is laid flat across the other two so that the thickness T of the combined strands is now twice the single thickness T. Then a second strand, opposite to the first strand, is bent and extended diagonally across the other two strands (FIG. 2*c*). At this point, the middle strand 20 is bent diagonally across the second strand (FIG. 2*d*). The first strand 20 is then bent again and laid flat across the middle strand (FIG. 2*e*). The braiding continues in this way until the braiding reaches the far ends 24 of the three strands of conductive tape 20, forming the braided flat conductive tape 22. The far ends 24 may be cut to create ends for electrical connection to other components.

This type of braiding generally produces braided tape 22 that is still relatively flat, generally only about twice the tape thickness T, while still being capable of carrying the desired electrical current, and while remaining flexible as needed to make electrical connections with other components. Alternatively, other different types of braiding patterns may be employed instead, if so desired, when braiding the individual strands of flat conductive tape 20 into the braided flat conductive tape 22.

Figure 3:
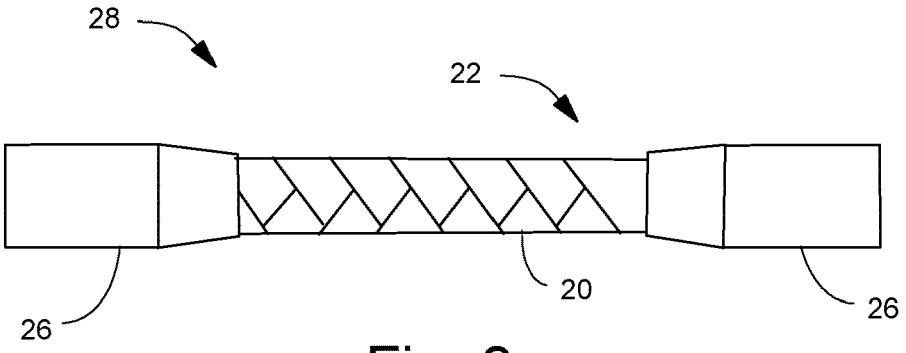
FIG. 3 is a schematic view of a braided flat conductive tape transitioned at both ends to solid flat wire.
Figure 4:
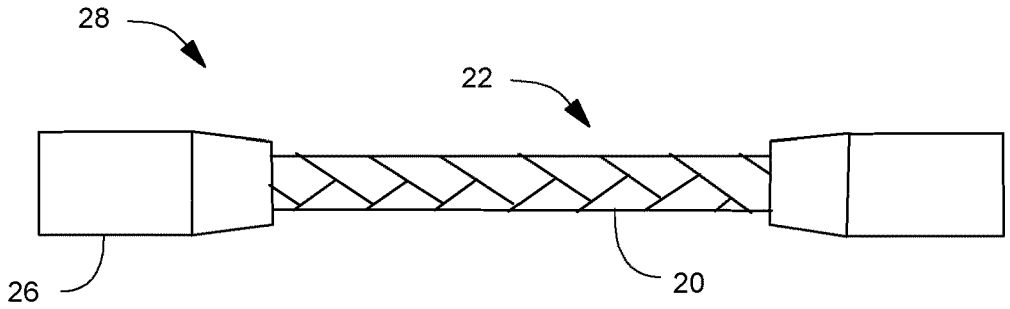
FIG. 4 is a schematic view similar to FIG. 3, but with the braided flat conductive tape extended along its length.
Figure 5A:
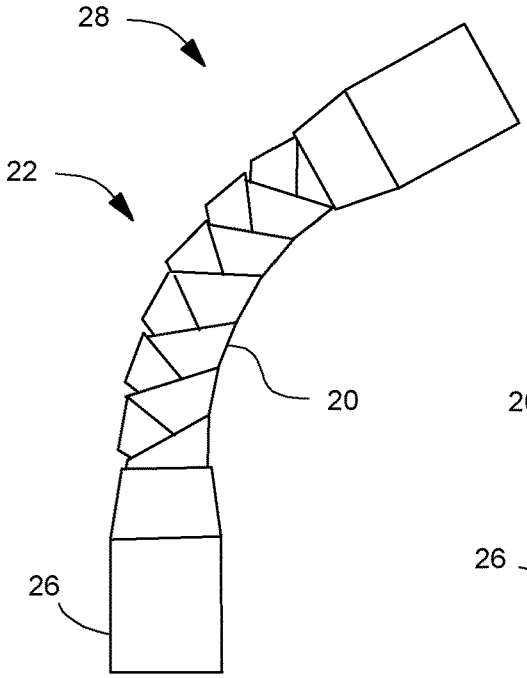
FIGS. 5*a* and 5*b* are schematic views similar to FIG. 3, but with the braided flat conductive tape curved in the direction of the tape width.
Figure 5B:
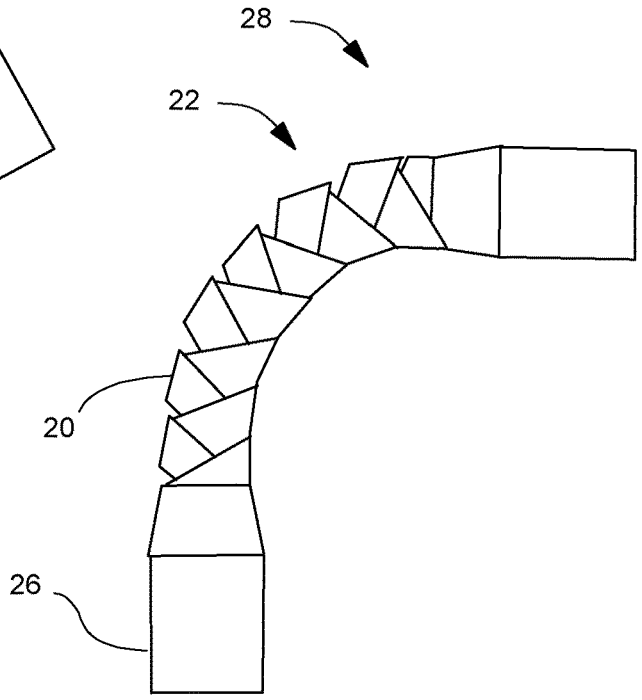

FIGS. 3-5 illustrate a length of braided flat conductive tape 22 that transitions to a solid flat conductor 26 at each end. In such an assembly 28, a solid flat conductor 26 is electrically and mechanically connected to all three pieces of the flat conductive tape 20 that make up the braided tape 22. This type of assembly 28 provides flexibility to account for tolerances and shaping the braided tape 22 as needed to connect the solid flat conductors 26 to other components. For example, FIG. 4 illustrates the ability to lengthen the overall assembly 28 when needed (the angle of the bent individual pieces of tape allows for the lengthening of the assembly without damaging the individual strands of tape 20). Additionally, FIGS. 5*a* and 5*b* illustrate the ability to curve the overall assembly 28 (widthwise) as needed to electrically mate with other components (the angle of the bent individual pieces of tape allows for the curving of the assembly without damaging the individual strands of tape 20).

Figure 6:
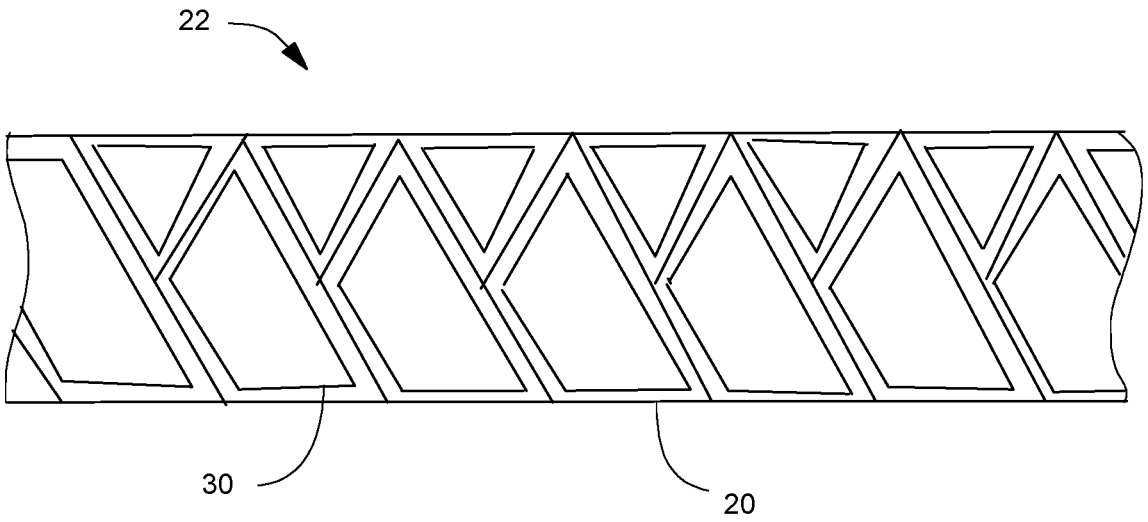
FIG. 6 is a schematic view of braided flat conductive tape having an adhesive backing.
Figure 7:
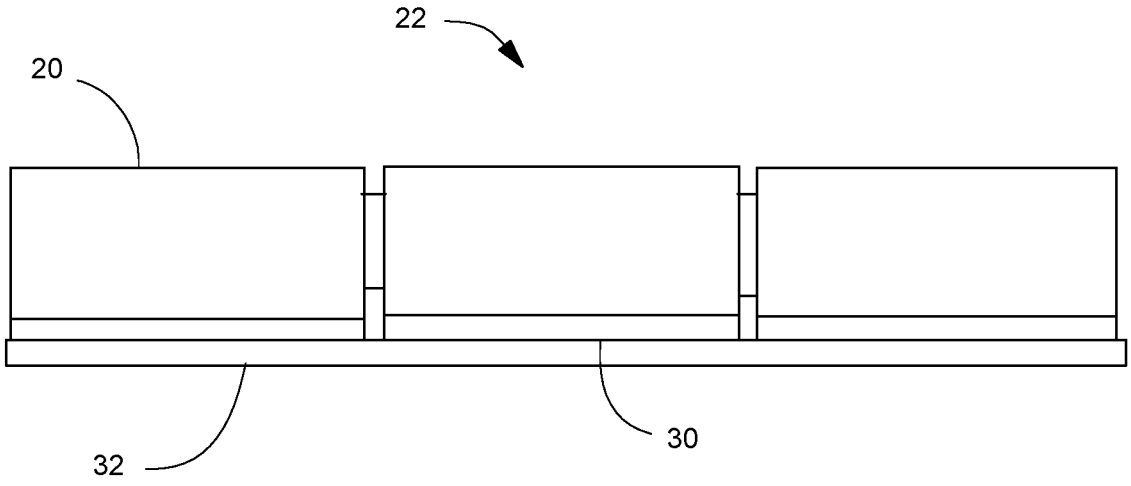
FIG. 7 is a schematic view of the braided flat conductive tape and adhesive applied to a substrate.

FIGS. 6 and 7 illustrate the braided flat conductive tape 22 with adhesive 30 applied along one side of a width of the braided flat conductive tape 22. The adhesive 30 may then be secured to a substrate 32 in the desired location for the braided tape 22. More specifically, after the braided flat conductive tape 22 is formed, whether with just a braided portion or as an assembly 28 such as in FIGS. 3-5*b*, the adhesive 30 is applied along a bottom of the braided tape 22 in segments that are applied over portions of individual strands 20 (see FIG. 6). In this way, the individual strands within the braid 22 can still move slightly relative to each other while still allowing the adhesive 30 to secure the braid 22 to the substrate 32. Accordingly, the braided tape 22 is shaped as needed relative to the substrate 32, and the adhesive 30 is secured to the substrate 32.

While certain embodiments of the present invention have been described in detail, those familiar with the art to which this invention relates will recognize various alternative designs and embodiments for practicing the invention as defined by the following claims.

The invention claimed is:

1. A method of forming a flat conductor comprising:

aligning multiple strands of flat conductive tape adjacent to each other;

braiding the strands of flat conductive tape to each other by sequentially bending one of the strands of flat conductive tape over the other strands of flat conductive tape to create a braided flat conductive tape; and applying adhesive in segments, with each of the segment of the adhesive applied to only one of the strands of the braided flat conductive tape, allowing for relative movement between the strands of the flat conductive tape.

2. The method of claim 1 wherein the adhesive segments are secured to a substrate to hold the braided flat conductive tape on the substrate.

3. The method of claim 1 further including attaching a solid flat conductor to one end of the braided flat conductive tape.

4. The method of claim 3 further including attaching a second solid flat conductor to an opposite end of the braided flat conductive tape.

5. The method of claim 1 wherein the multiple strands of flat conductive tape are three strands, with each bending over the other two such that a thickness of the braided flat conductive tape is twice the thickness of one of the strands of the flat conductive tape.

6. A method of forming a flat conductor comprising:

aligning multiple strands of flat conductive tape adjacent to each other;

braiding the strands of flat conductive tape to each other by sequentially bending one of the strands of flat conductive tape over the other strands of flat conductive tape to create a braided flat conductive tape;

connecting each end of the braided flat conductive tape to an electrical assembly for carrying electrical current therethrough; wherein the multiple strands of flat conductive tape are three strands, with each bending over the other two such that a thickness of the braided flat conductive tape is twice the thickness of one of the strands of the flat conductive tape; and bending the braided flat conductive tape about a width before connecting each end of the braided flat conductive tapes to the electrical assembly.

7. The method of claim 6 further including applying adhesive in segments, with each of the segment of the adhesive applied to only one of the strands of the braided flat conductive tape, allowing for relative movement between the strands of the flat conductive tape.

8. The method of claim 7 wherein the adhesive segments are secured to a substrate to hold the braided flat conductive tape on the substrate.

9. The method of claim 7 further including attaching a solid flat conductor to one end of the braided flat conductive tape.

10. The method of claim 6 further including attaching a solid flat conductor to one end of the braided flat conductive tape.

11. The method of claim 10 further including attaching a second solid flat conductor to an opposite end of the braided flat conductive tape.

12. A method of forming a flat conductor comprising:

aligning multiple strands of flat conductive tape adjacent to each other;

braiding the strands of flat conductive tape to each other by sequentially bending one of the strands of flat conductive tape over the other strands of flat conductive tape to create a braided flat conductive tape;

connecting each end of the braided flat conductive tape to an electrical assembly for carrying electrical current therethrough; and applying adhesive in segments, with each of the segment of the adhesive applied to only one of the strands of the braided flat conductive tape, allowing for relative movement between the strands of the flat conductive tape.

13. The method of claim 12 wherein the adhesive segments are secured to a substrate to hold the braided flat conductive tape on the substrate.

14. The method of claim 12 further including attaching a solid flat conductor to one end of the braided flat conductive tape.

* * * * *